US005456154A

United States Patent [19]

Golden

[11] Patent Number: 5,456,154

[45] Date of Patent: Oct. 10, 1995

[54] COMPACT BUSTLE MAGAZINE

[75] Inventor: Michael D. Golden, Corona del Mar, Calif.

[73] Assignee: Western Design Corporation, Irvine, Calif.

[21] Appl. No.: 219,185

[22] Filed: Mar. 29, 1994

[51] Int. Cl.[6] ..... F41A 9/34

[52] U.S. Cl. ..... 89/33.16; 89/34; 89/35.01

[58] Field of Search ..... 89/34, 33.16, 33.17, 89/33.2, 33.25, 33.14, 45, 33.02, 35.01

[56] References Cited

U.S. PATENT DOCUMENTS

| | | | |
|---|---|---|---|
| 2,456,620 | 12/1948 | Chadwick et al. | 89/45 |
| 2,822,730 | 2/1958 | Brennan et al. | 89/45 |
| 3,109,344 | 11/1993 | Andersson et al. | 89/34 |
| 4,873,911 | 10/1989 | Suchocki | 89/34 |
| 4,928,574 | 5/1990 | Golden | 89/34 |
| 5,170,006 | 12/1992 | Maheret et al. | 89/33:16 |

FOREIGN PATENT DOCUMENTS

| | | | |
|---|---|---|---|
| 538137 | 4/1993 | European Pat. Off. | 89/33.16 |
| 2261055 | 5/1993 | United Kingdom | 89/33.14 |

*Primary Examiner*—Stephen M. Johnson
*Attorney, Agent, or Firm*—Walter A. Hackler

[57] ABSTRACT

A magazine for storing ammunition rounds includes a plurality of tubular ammunition canisters and a plurality of link assemblies with each link assembly supporting three ammunition rounds in a nested arrangement with longitudinal axes of each of the three supported canisters being approximately equidistant from one another. The link assemblies are interconnected to form a continuous loop and a chassis is supported for supporting the continuous loop in order that the centers of the link assemblies form loci on an oval pattern. The loops and canisters may be moved along the continuous loop by a drive unit and doing such movement the three canisters maintain a fixed spacial relationship as supported by the assembly.

24 Claims, 6 Drawing Sheets

FIG. 7.
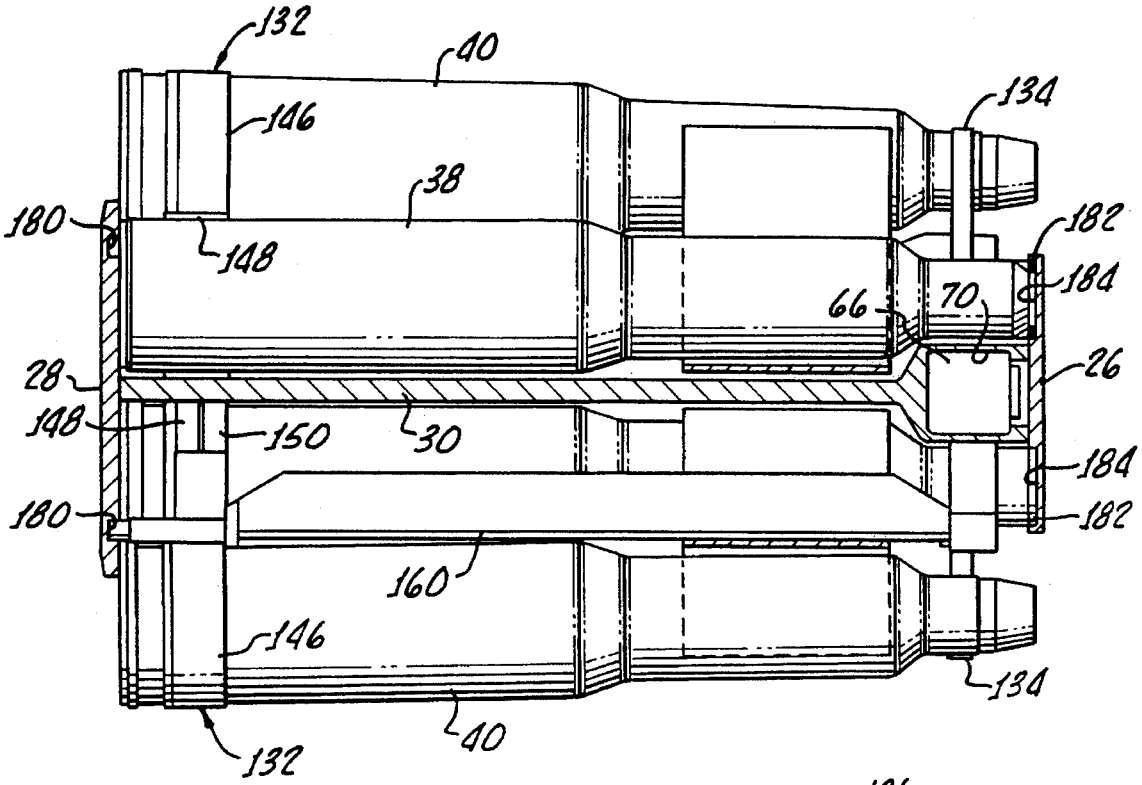
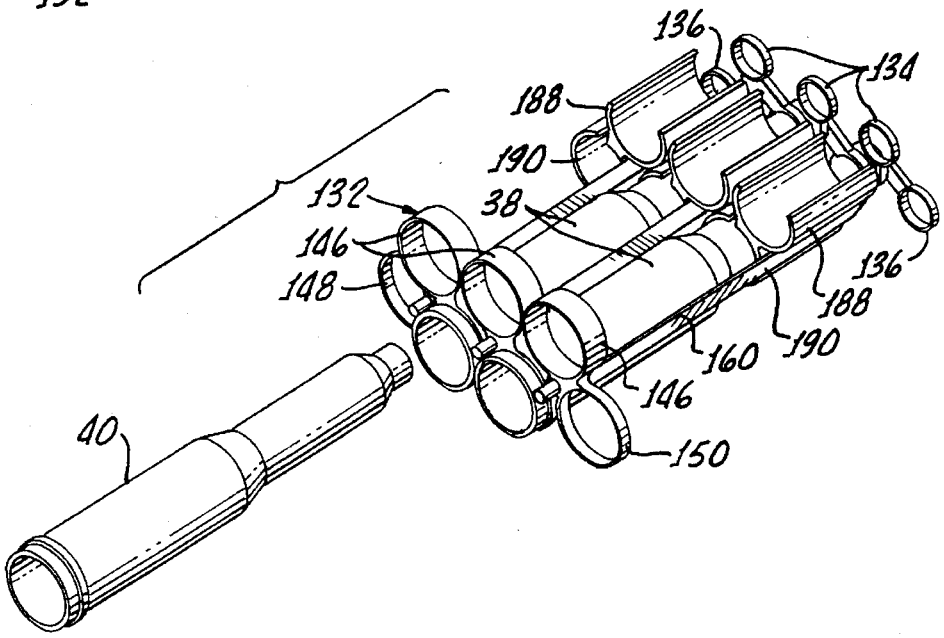
FIG. 8.

COMPACT BUSTLE MAGAZINE

The present invention generally relates to ammunition magazine systems and more particularly is directed to a bustle magazine system for use in combat vehicles, such as tanks and heavy artillery vehicles.

Existing ammunition magazines are typically disposed separate from the gun system in a tank and because the tank and gun system typically require personnel for the operation thereof, the storage of ammunition for future use is hazardous in the event that enemy fire should penetrate the bustle and ignite one of the stored rounds. And accordingly, the magazines are typically enclosed in armored plate with access thereto being limited to one or more large armored blast doors to protect the crew in the event of ammunition fire in the bustle.

Existing tanks typically have a limited compartment for ammunition storage with the magazine disposed therein having to fit a generally rectangular compartment. While the ammunition in the compartment may be stored in fixed racks or canisters, an ammunition magazine has been patented which provide for endless inner and outer loops of ammunition canisters for carrying ammunition to a small access port. This magazine is described in U.S. Pat. No. 4,873,911 to Suchocki.

This magazine, in fact, does provide for tight nesting of ammunition in order to most efficiently utilize the space allocated for ammunition storage. However, this magazine concept has not been developed because of at least two major drawbacks inherent to the concept.

First, the Suchocki patent does not reveal any practical means to guide and control the motion and path of the inner and outer rows as they circulate around the end turns. Any such means must, of necessity, allow for the chordally foreshortened path of chain length as a chain moves in a oval pattern. Further, it is well recognized that accurate and low friction guidance means are highly desirable if one wishes to move a conveyance system at high speeds, and avoid the occurrence of jams which inevitably happen with inadequately guided and controlled conveyance paths.

Second, the Suchocki patent does not envision the use of conventional drive sprockets, nor does it appear that same are even possible due to the above mentioned problems. Rather, the Suchocki patent refers vaguely to "schematically shown" drive means which "apparently" operate upon the outer row of canisters during the straight portion of their path. Any such means will obviously be cumbersome, bulky, will probably require considerable power, and may not be capable of high conveyance rates. Further, since any such means will, of necessity, occupy considerable space outside of the envelope shown, much of the compactness envisioned will, in fact, be lost.

An improved powered ammunition magazine system utilizing a monocoque structure is disclosed in U.S. Pat. No. 4,928,574 to Golden. This magazine provides for rotational mounting of the ammunition magazine for enabling a handler to remove ammunition from the magazine without undergoing severe translational movement. It further eliminates the need for large doors, heretofore necessary for ammunition access and therefore enables safer storage of the ammunition rounds during combat. However, such structure must be essentially cylindrical and it is not always amenable for use in retrofitting tanks having existing fixed space or compartment for the use or storage of ammunition.

The present invention overcomes the drawbacks of the Suchocki magazine by providing for complete path guidance and control, 100% anti-friction bearing support of the conveyance system, the use of rotatable drive sprockets propelling the system at the end turns, and packaging of the drive system entirely within the envelope shown.

The present invention therefor provides a bustle magazine which requires no major modification to an existing basic turret structure nor change to the turret armor or exterior envelope of the tank turret. Further, the present invention provides a powered bustle magazine with thirty-four ready rounds, which is equal to the existing Wegmann fixed rack storage system currently utilized by the U.S. M1A1 battle tank. Anti-fratricide protection is easily incorporated into the bustle magazine in accordance with the present invention, and the magazine is fully compatible for use with a transfer unit to achieve full automatic capability.

SUMMARY OF THE INVENTION

An ammunition magazine in accordance with the present invention generally includes a plurality of tubular ammunition canisters, along with a plurality of link assemblies, with each link assembly having means for supporting three ammunition canisters in a nested arrangement, with the longitudinal axis of each of the three supported canisters being approximately equidistant from one another. In this manner, compact dense storage of ammunition is enabled with little free space existing between ammunition rounds. Further, the three ammunition canisters are attached to each link assembly in a manner fixing the distance between the longitudinal axes of the canisters in order to ensure the dense packed configuration.

Means are provided for interconnecting the link assemblies to form a continuous loop and a chassis provides a means for supporting the continuous loop in order that the center of each link assembly forms the loci of an oval pattern. The chassis may include a nose plate, a base plate and a central panel attached to central portions of the nose plate and the base plate in order to support the nose and base plate in a parallel spaced apart configuration. Spacing between the nose plate and the end plate is sufficient for supporting the canisters there between.

More particularly, each link assembly comprises nose link means for supporting nose portions of the three canisters and base link means for supporting base portions of the three canisters. The nose link means and the base link means are held in an axially spaced apart relationship by a connecting bar. More specifically, the nose link means and the base link means each comprise ring means for circumferentially supporting two canisters and enabling the two canisters to rotate within the ring means. These two canisters are, in fact, the means by which the interconnecting links are formed into a continuous loop, in that the canisters act as the "chain pins" in exactly the same manner. Adjacent links of a conventional roller chain are interconnected via encompassing the "chain pin". In addition, the nose link means and the base link means includes a link to which a third canister is fixed independently of adjacent links.

The nose plate may include means defining an oval guide in the nose plate for guiding the canisters nose portions in the oval pattern and the base plate may include means defining an oval groove in the base plate for guiding the base link means in the oval pattern. Preferably, motor means are provided for moving the link assemblies and attached canisters around the oval pattern in order to provide access to individual canisters for the loading and unloading of ammunition magazine rounds thereinto and there out of.

Motor driven rotatable sprockets may be utilized as a means for engaging in moving the canisters within the oval and anti-fratricide elements may be attached to the connecting bar and disposed between adjacent canisters portions.

BRIEF DESCRIPTION OF THE DRAWINGS

A better understanding of the present invention may be had from the consideration of the following detailed description, taken in conjunction with the accompanying drawings in which:

FIG. 7 is a perspective view of the link assembly in accordance with the present invention showing anti-fratricide elements; and FIG. 8 is a perspective view of several link assemblies in accordance with the present invention with some canisters installed.

DETAILED DESCRIPTION

Figure 1:
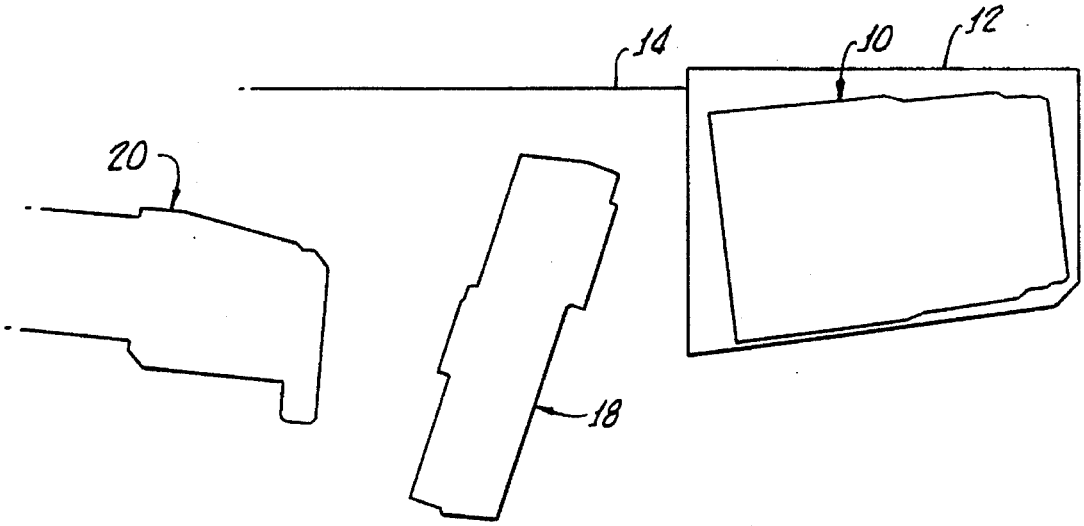
FIG. 1 is an outline of the magazine in accordance with the present invention as it may be disposed relative to a transfer mechanism for loading ammunition rounds from the ammunition magazine into the breach of a weapon.

Turning now to FIG. 1, there is shown in ammunition magazine 10 in accordance with the present invention as it may be disposed within a compartment 12 of a turret 14 which also houses a transfer mechanism 18 and a gun 20.

The transfer mechanism 18 is not part of the present invention but is merely shown to convey the relative position of the magazine 10 within the turret 14. The transfer mechanism 18 functions to transfer rounds of ammunition from the magazine 10 to the gun 20. No specific details are provided for the turret 14, transfer mechanism 18 or gun 20 as they are not part of the present invention.

Figure 2:
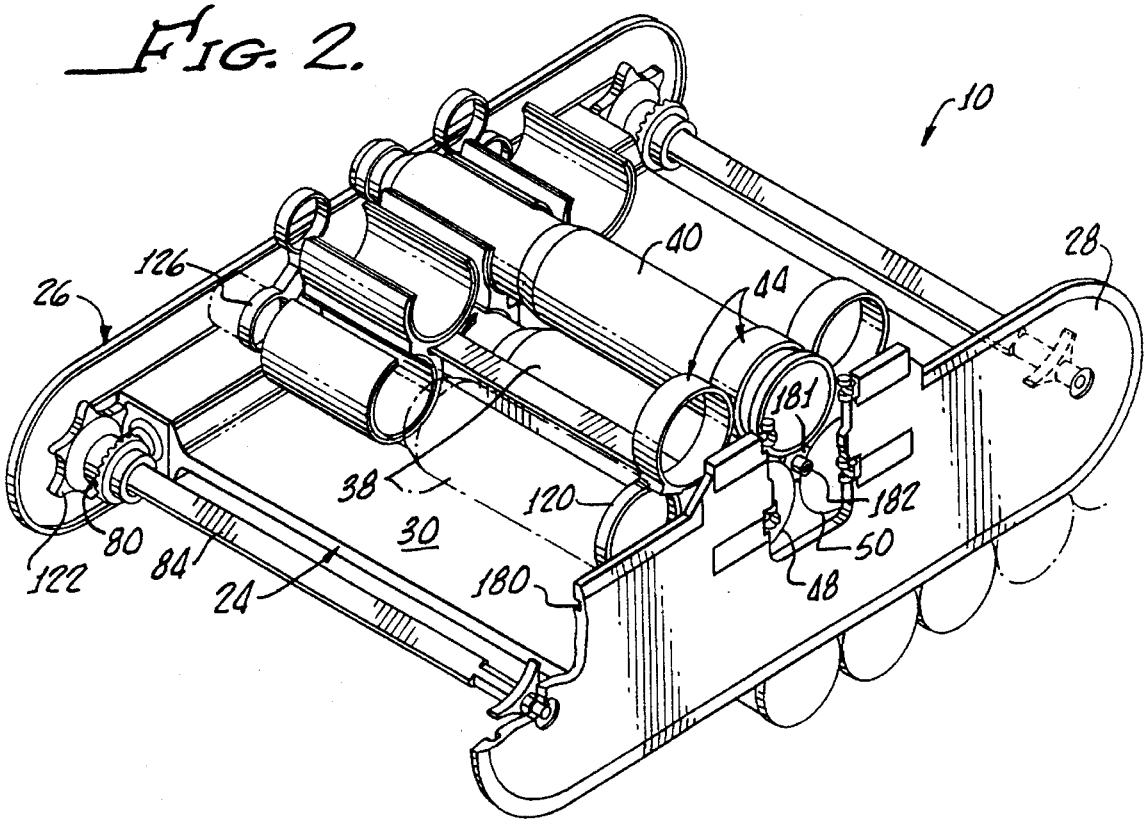
FIG. 2 is a perspective view, partially broken away, of the ammunition magazine in accordance with the present invention.
Figure 3:
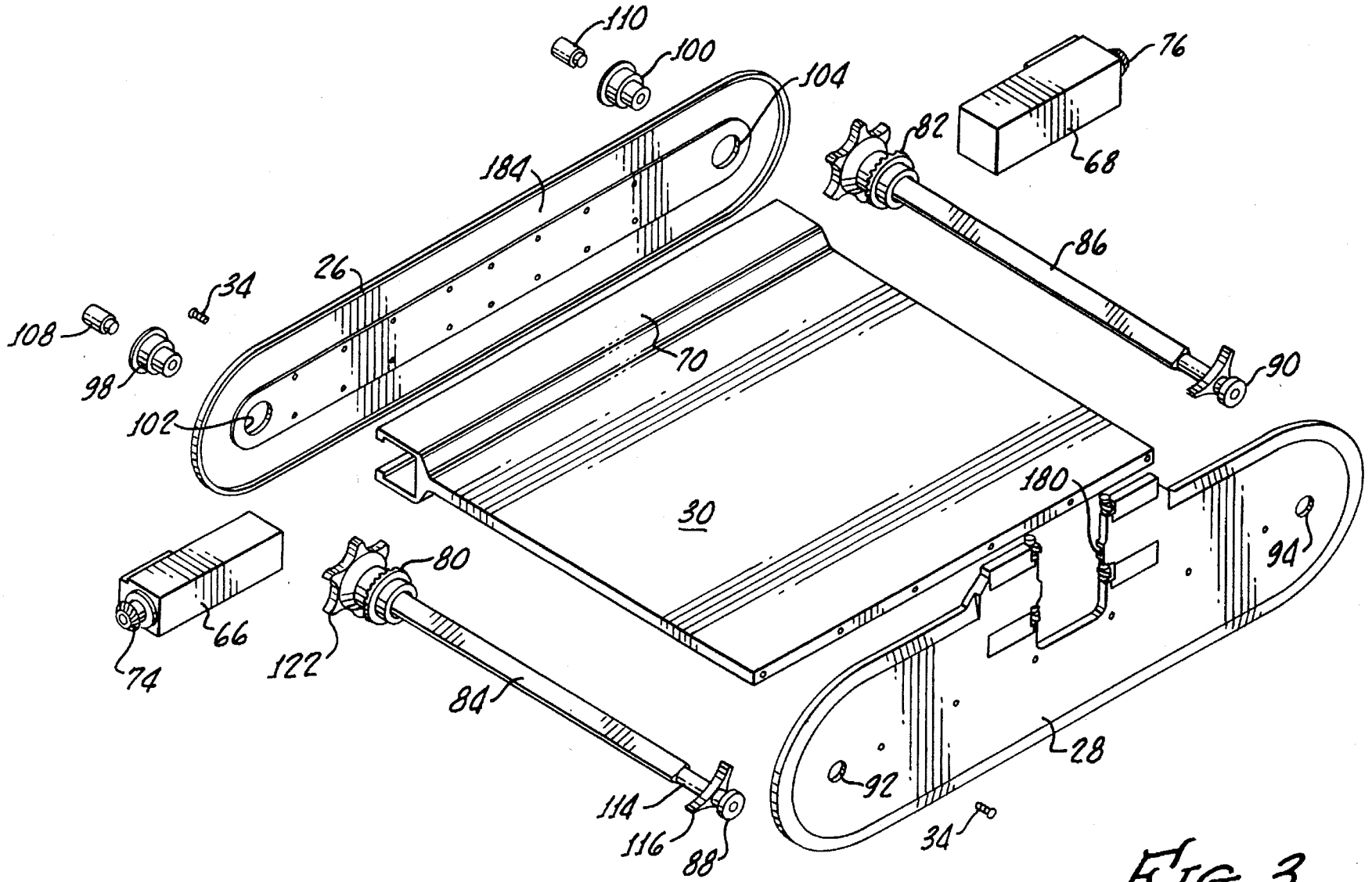
FIG. 3 is an exploded perspective view of the chassis assembly in accordance with the present invention.

FIG. 2 shows a perspective view of the magazine 10, partially broken away in order to more clearly show a chassis 24 which includes a nose plate 26 and a base plate 28 which are held in a spaced apart generally parallel relationship by a central panel 30 which may be attached to the base plate and nose plate by screws 34 or the like as more clearly shown in FIG. 3.

Figure 4:
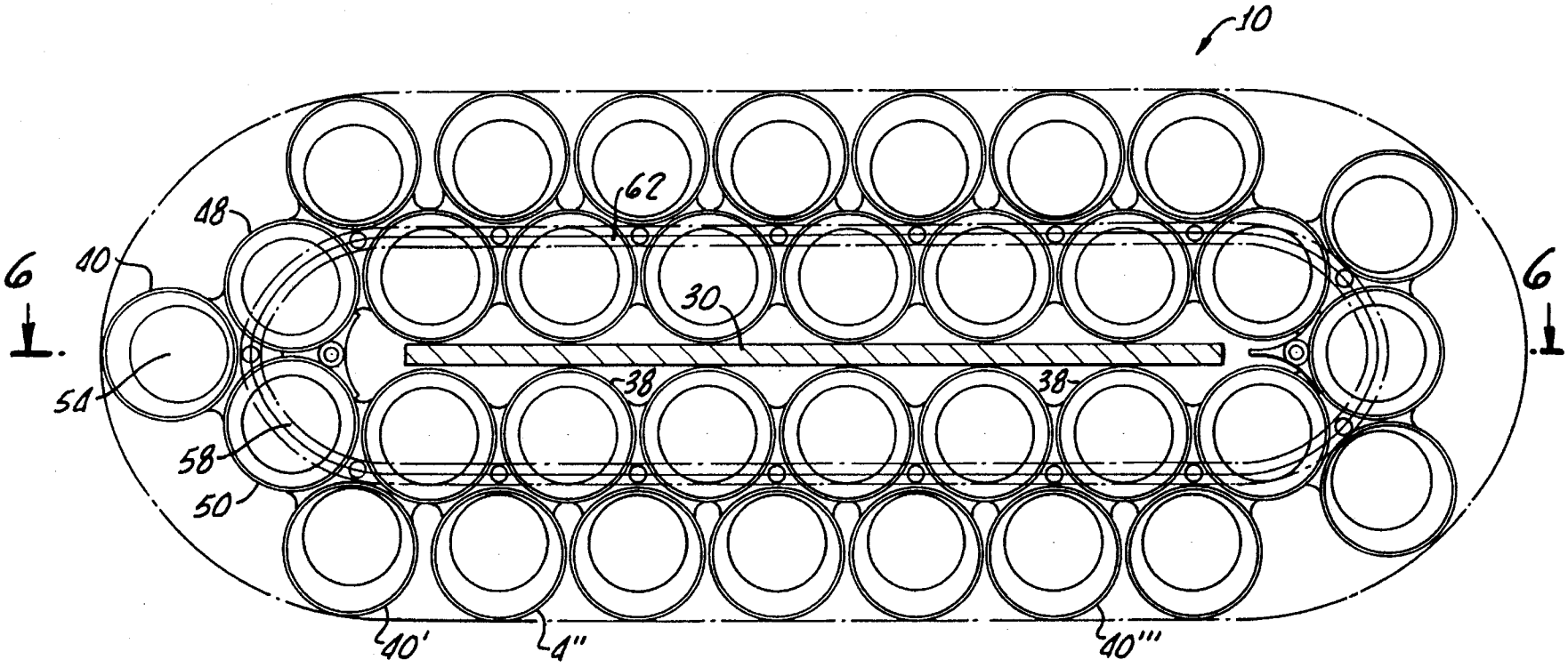
FIG. 4 is an end view of the magazine in accordance with the present invention taken at the base of the magazine.

Turning again to FIG. 2, the magazine 10 further includes a plurality of inner canisters 38 and outer canisters 40 disposed in a nested configuration as shown in the end view of the magazine 10 shown in FIG. 4.

Figure 5:
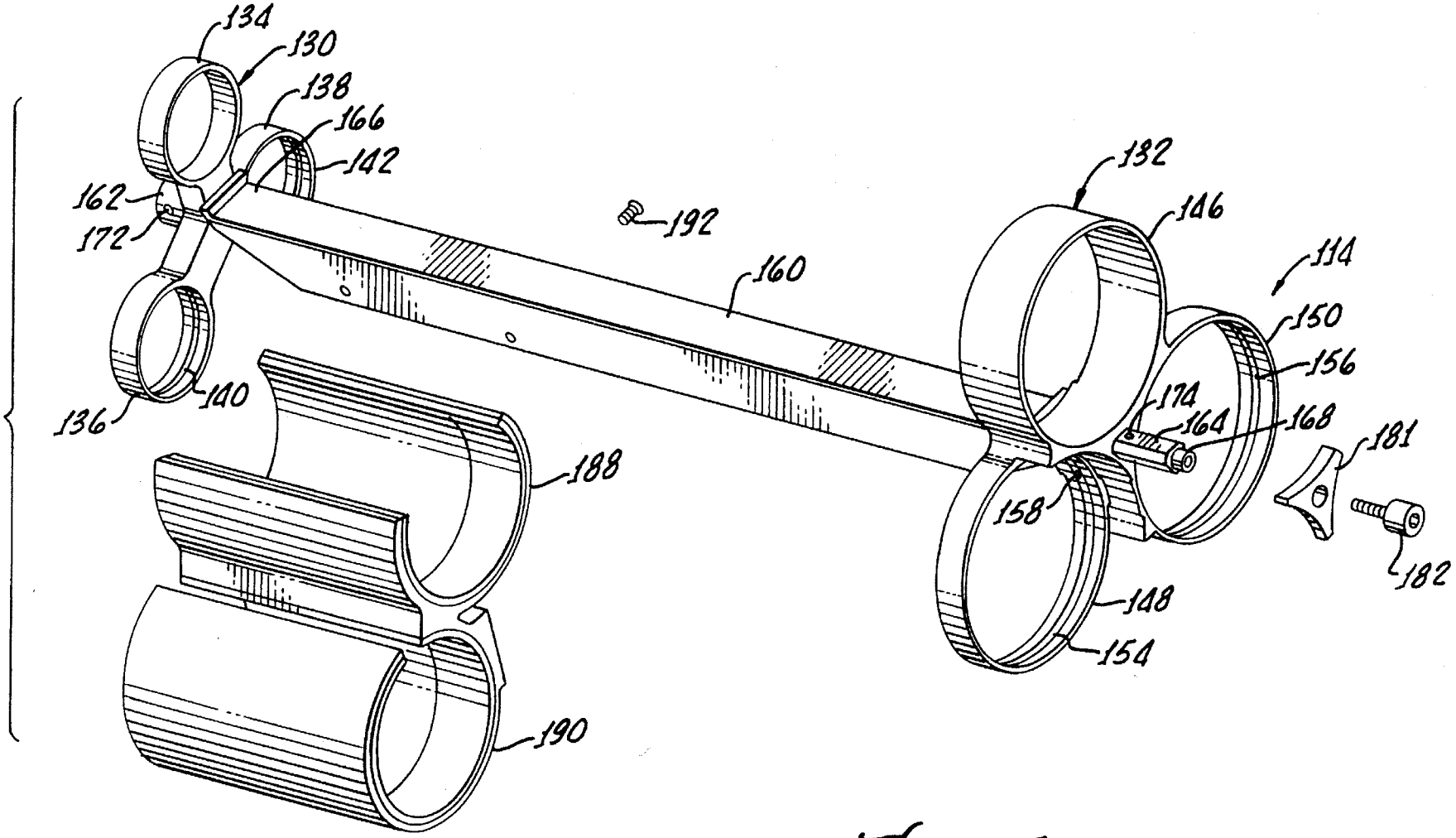
FIG. 5 is a cross-sectional view taken along line 5—5 of FIG. 4.

As shown in FIG. 2, and more clearly in FIG. 5, a plurality of link assemblies 44 provide a means for supporting three ammunition canisters identified as 40, 48 and 50 in FIGS. 2 and 4 in a nested arrangement with longitudinal axes 54, 56, 58 of each of the three canisters 40, 48, 50 being approximately equidistant from one another, all three ammunition canisters 40, 48, 50 being attached to the link assembly 44 in a manner fixing the distance between the longitudinal axes 54, 56, and 58.

It should be appreciated that while the canisters are caused to move in an oval pattern as shown by the line 62 in FIG. 4 about the central panel 30 the relative positions of each three canisters 40, 48, 50 supported by link assembly 44 do not change in position. Thus, the nested configuration of all the rounds is maintained even though the rounds may be moved in the oval pattern 62 with the canisters 38, 48, 50 remaining proximate to the central panel 30 and the outer canister 40, 40', 40", . . . remaining distal to the central panel 30.

As shown in FIG. 4, the total number of inner canisters 38, is 17. While a larger or smaller number of inner canisters 38 may be used, it is important that the total number of inner canisters 38 be odd, i.e., 15, 17, 19, 27 etc. This configuration enables a substantially uniform path length of the inner canisters 38 as they are moved in the oval pattern. This should be contrasted with the magazine described in U.S. Pat. No. 4,873,911 to Suchochi, which includes an inner set of canisters of even total number.

It has been found that when an even number of inner canisters 38 are used, canisters are disposed directly opposite one another at the ends of the oval pattern (See Suchochi). However, in the case of the present invention, the inner canisters, having an odd total number can never be disposed at opposite ends of the ova pattern 62. This structure causes the path length of the inner canisters 38, measured along the oval pattern 62, to be substantially constant.

As shown in FIG. 3, two electrical gear motor assemblies 66 and 68 found within a forked portion 70 provide a means for moving the link assemblies 44 and attached canisters 44, 48, and 50 around the oval pattern 62 between the nose plate 26 and base plate 28 and around the central panel 30.

The motor assemblies are fitted with drive gears 74 and 76 which engage driven gears 80 and 82 attached to shafts 84 and 86 carried by base journals 88, 90 in openings 92, 94 in the base plate and by journals 98, 100 in openings 102, 104 and the nose plate 26 fittings 108, 110 may be used to secure the shafts 84, 86, respectively between the nose plate 26 and the base plate 28.

Fixed approximate to base end 114 of the shaft 84 is a sprocket 116 for engaging the canisters 38 at a base portion 120 while a sprocket 122 approximate a nose end of the shaft 84 is positioned for engaging nose portions 126 in order to drive the canisters 38, 40 in the oval pattern 62 while in the link assemblies 44.

As shown in FIGS. 2 and 5, the link assemblies 44 generally include nose links 130 which provide a means for supporting the canister nose portions 126 and base links 132 for which provided means for supporting base portions of the canisters 40. Each of the nose links comprise three rings 134, 136 and 138 with the inner rings 136, 138 being provided with oil rings 140, 142 to enable rotation of the canisters 48, 50 therein.

Similarly the base link 132 includes rings 146, 148,150 for supporting base portions of the canisters 40, 48 and 50 with the rings 148, 150 including oil rings 154, 156 for enabling rotation of the canisters 48 and 50 during their course of travel along the path 62 and around the central panel 30. Oil ports 158 supply oil to the oil rings 154, 156.

A connecting bar 160 interconnects the nose link 130 and base link 132 and maintains the nose and base links 130, 132 in a spaced apart relationship suitable for engaging and supporting the nose portions and end portions of the canisters 40, 48 and 50. Stops 162, 164 attached at opposite ends 166, 168 and secured thereto by set screws 172,174 or the like secures the bar 160 to the nose link 130 and base link 132.

Canisters 44, 48, 50 are retained axially to connecting bar 160 via retainer 181 and cam follower 182, the retainer 181 being sandwiched between stop 168 and the cam follower 182. The latter is preferably a sealed needle bearing follower in order to support and guide the base end of link assembly 44 with minimum friction in groove 180 of the base plate 28.

Nose portions of the inner canisters 38 include ball bearings 182 and are guided along the nose plate 26 in an oval channel 184 along the oval pattern 62.

Figure 6:
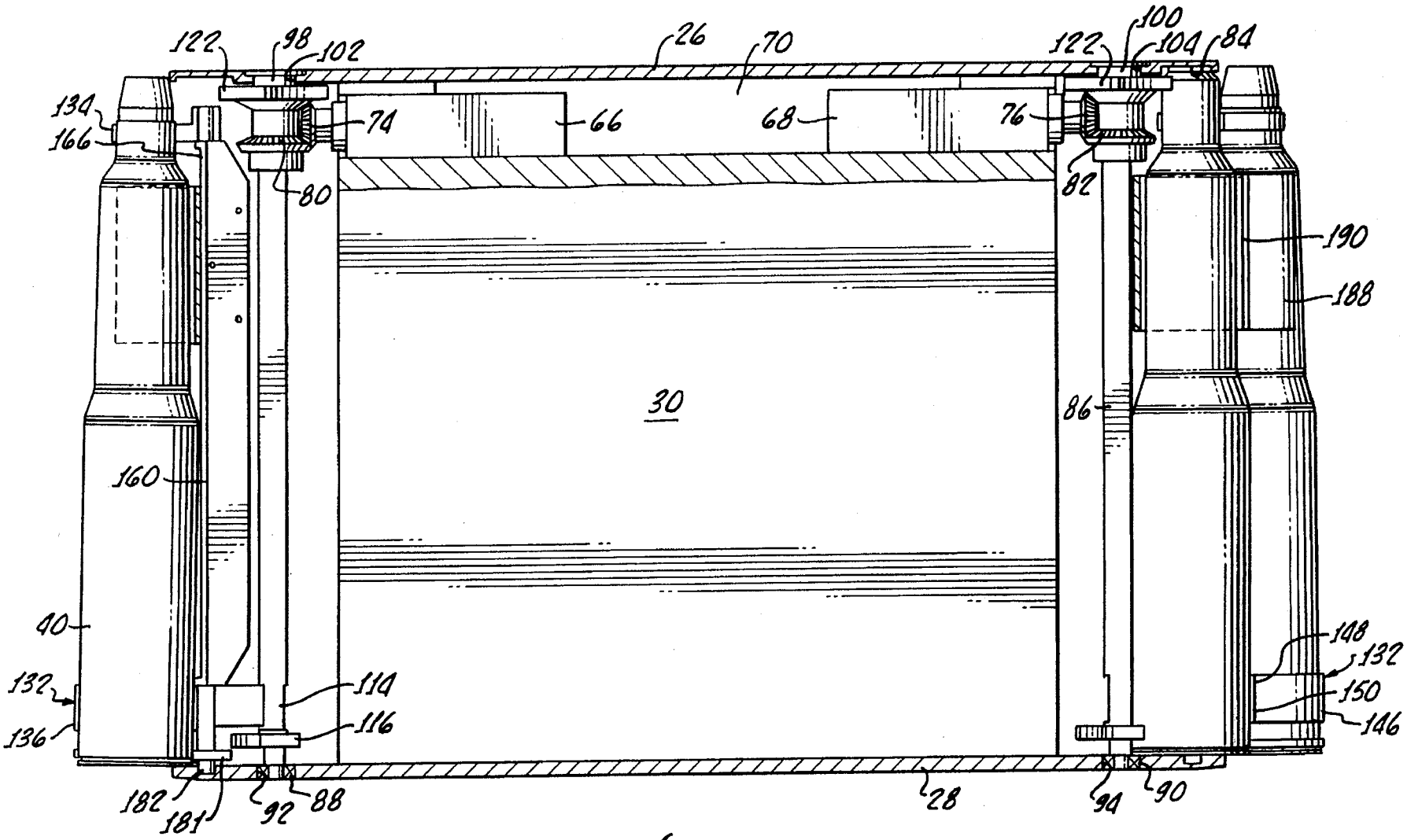
FIG. 6 is a cross-sectional view taken along line 6—6 of FIG. 4.

FIG. 6 shows a magazine 10 horizontal section and FIG. 7 shows a magazine 10 center section which also shows anti-fratricide elements 188, 190 which are more clearly shown in FIG. 5 and 8 in which the element 188 provides outer-row fratricide protection and the element 190 provides inner-row fratricide protection. The elements 188, 189 may be formed from well-known materials suitable for anti-fratricide elements in magazines and the elements may be fixed to the bar 160 by screws 192.

Although there has been described hereinabove a specific ammunition magazine in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A magazine for storing ammunition rounds, said magazine comprising:

a plurality of tubular ammunition canisters, each said canister being sized for holding one of said ammunition rounds;

a plurality of link assemblies, each said link assembly having means for supporting three ammunition canisters of the plurality of canisters in a nested arrangement with longitudinal axis of each of the three supported canisters being approximately equidistant from one another, said three supported ammunition canisters being attached to each said link assembly with a fixed distance between the longitudinal axes of the canisters;

means for interconnecting said link assemblies to form a continuous loop with the three supported ammunition canisters of each said link assembly being aligned so that each of the three ammunition canisters is a member of one of (i) an inner set of canisters and (ii) an outer set of canisters;

chassis means for supporting said continuous loop in order that centers of the link assemblies form loci of an oval pattern; and motor means for moving said link assemblies and attached canisters around said oval pattern.

2. The magazine according to claim 1 wherein a total number of the inner canisters is odd.

3. The magazine according to claim 1 wherein each said link assembly comprises nose link means for supporting nose portions of the three canisters and base link means for supporting base portions of the three canisters, said nose link means and base link means having held in a spaced apart relationship by a connecting bar.

4. The magazine according to claim 3 wherein the nose link means and the base link means each comprise ring means for circumferentially supporting two of the three canisters and enabling said two canisters to rotate within the ring means.

5. The magazine according to claim 4 wherein the nose link means and the base link means each further comprise a ring fixed to a third canisters.

6. The magazine according to claim 5 wherein said chassis means comprises a nose plate and a base plate with a central panel fixed therebetween.

7. The magazine according to claim 6 wherein said nose plate means, defines an oval channel in said nose plate, for guiding the canister nose portions in said oval channel.

8. The magazine according to claim 7 wherein said base plate comprises means, defining an oval groove in said base plate for guiding the base link means in said oval pattern.

9. The magazine according to claim 8 wherein said oval pattern is disposed around the central panel.

10. The magazine according to claim 9 wherein the means for moving said link assemblies comprises spaced apart, motor driven, rotatable sprocket means for engaging and moving the canisters.

11. The magazine according to claim 10 wherein the sprocket means comprises a nose sprocket positioned for engaging the canister nose portions and a rear sprocket positioned for engaging the canister base portions.

12. The magazine according to claim 11 further comprising anti-fratricide elements attached to said connecting bar and disposed between adjacent said canister nose portions.

13. A magazine for storing ammunition rounds, said magazine comprising;

a chassis having a nose plate, a base plate and a central panel attached to central portions of said nose plate and base plate, said nose plate and said base plate being supported in a parallel spaced apart relationship by said central panel;

a plurality of tubular ammunition canisters, each said canister being sized for holding one of said ammunition rounds;

a plurality of link assemblies, each said link assembly having means for supporting three ammunition canisters in a nested arrangement with longitudinal axis of each of the three supported canisters being approximately equidistant from one another, said three ammunition canisters being attached to each said link assembly with a fixed distance between the longitudinal axes of the canisters;

means for interconnecting said link assemblies to form a continuous loop with the three supported ammunition canisters of each said link assembly being aligned so that each of the three ammunition canisters is a member of one of (i) an inner set of canisters and (ii) an outer set of canisters; and means for enabling movement of the link assemblies with canisters attached around the central panel and between the nose and base plates in an oval pattern.

14. The magazine according to claim 13 wherein a total number of the inner canisters is odd.

15. The magazine according to claim 14 further comprising motor means for moving said link assemblies with attached canisters around the oval pattern.

16. The magazine according to claim 15 wherein each said link assembly comprises nose link means for supporting nose portions of the three canisters and base link means for supporting base portions of the three canisters, said nose link means and base link means being held in a spaced apart relationship by a connecting bar.

17. The magazine according to claim 16 wherein the nose link means and the base link means each comprise ring means for circumferentially supporting two of the three canisters and enabling said two canisters to rotate within the ring means.

18. The magazine according to claim 17 wherein the nose link means and the base link means each further comprise a ring fixed to a third canister.

19. The magazine according to claim 18 wherein said nose plate comprises means, defines an oval channel in said nose plate, for guiding the canister nose portions in said oval channel.

20. The magazine according to claim 19 wherein said base plate comprises means defining an oval groove in said base plate for guiding the base link means in said oval pattern.

21. The magazine according to claim 20 wherein said oval pattern is disposed around the central panel.

22. The magazine according to claim 21 wherein the means for moving said link assemblies comprises spaced apart, motor driven, rotatable sprocket means for engaging and moving the canisters.

23. The magazine according to claim 22 wherein the sprocket means comprises a nose sprocket positioned for engaging the canister nose portions and a rear sprocket positioned for engaging the canister base portions.

24. The magazine according to claim 23 further comprising anti-fratricide elements attached to said connecting bar and disposed between adjacent said canister nose portions.

* * * * *